US010979837B2

(12) United States Patent
Hultermans et al.

(10) Patent No.: US 10,979,837 B2
(45) Date of Patent: Apr. 13, 2021

(54) MICROPHONE CALIBRATION SYSTEM

(71) Applicant: SIGNIFY HOLDING B.V., Eindhoven (NL)

(72) Inventors: Martijn Marius Hultermans, Eindhoven (NL); Edith Danielle Den Hartog, Eindhoven (NL); Bram Francois Joosen, Breda (NL); Alexandre Georgievich Sinitsyn, Veldhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/759,587

(22) PCT Filed: Oct. 19, 2018

(86) PCT No.: PCT/EP2018/078668
§ 371 (c)(1),
(2) Date: Apr. 27, 2020

(87) PCT Pub. No.: WO2019/081358
PCT Pub. Date: May 2, 2019

(65) Prior Publication Data

US 2020/0296529 A1 Sep. 17, 2020

(30) Foreign Application Priority Data

Oct. 27, 2017 (EP) ..... 17198793

(51) Int. Cl.
*H04R 29/00* (2006.01)

(52) U.S. Cl.
CPC ..... *H04R 29/004* (2013.01)

(58) Field of Classification Search
CPC .... H04R 29/004; H04R 3/005; H04R 29/006; G08G 1/017
USPC ..... 381/56–58, 86, 91, 92, 122
See application file for complete search history.

(56) References Cited

U.S. PATENT DOCUMENTS

| | | | | |
|---|---|---|---|---|
| 7,522,736 | B2 | 4/2009 | Adcock et al. | |
| 9,615,066 | B1 * | 4/2017 | Tran | G08G 1/09 |
| 2012/0062123 | A1 * | 3/2012 | Jarrell | H05B 47/105 315/131 |

(Continued)

FOREIGN PATENT DOCUMENTS

WO 2016156563 A1 10/2016

OTHER PUBLICATIONS

Samuel Dauwe et al, "Multi-criteria anomaly detection in urban noise sensor networks", Environ. Sci.: Processes Impacts, vol. 16, No. 10, Jul. 29, 2014, pp. 2249-2258, DOI: 10.1039/C4EM00273C.

(Continued)

*Primary Examiner* — Norman Yu
(74) *Attorney, Agent, or Firm* — Daniel J. Piotrowski

(57) ABSTRACT

Some embodiments are directed to a microphone calibration system (100) for multiple microphones (110), said microphones being arranged in an area in which moving objects pass the microphones. The system computes a first and second sound profile from first and second sound measurements, said first and second sound profiles being indicative of a calibration of the first and second microphones, and determines a need to calibrate the first or second microphone.

12 Claims, 7 Drawing Sheets

(56) References Cited

U.S. PATENT DOCUMENTS

| | | | |
|---|---|---|---|
| 2015/0124980 | A1 | 5/2015 | Vilermo et al. |
| 2017/0099718 | A1 | 4/2017 | Stout et al. |

OTHER PUBLICATIONS

Federico Dominguez et al, "Active Self-Testing Noise Measurement Sensors for Large-Scale Environmental Sensor Networks", Sensors, vol. 13, No. 12, Dec. 13, 2013, pp. 17241-17264, XP055463790, DOI: 10.3390/s131217241.

Barnwal Shubhranshu et al, "Doppler based speed estimation of vehicles using passive sensor", 2013 IEEE International Conference on Multimedia and Expo Workships(ICMEW). IEEE, Jul. 15, 2013, pp. 1-4, DOI: 10.1109/ICMEW.2013. 6618278.

* cited by examiner

| x | dist | SPL1 | amplitude | SPL2 |
|---|---|---|---|---|
| -17 | 18.81 | 74.51 | 0.43 | 67.06 |
| -16 | 17.92 | 74.93 | 0.45 | 67.44 |
| -15 | 17.03 | 75.38 | 0.47 | 67.84 |
| -14 | 16.16 | 75.83 | 0.50 | 68.25 |
| -13 | 15.30 | 76.31 | 0.53 | 68.68 |
| -12 | 14.46 | 76.80 | 0.56 | 69.12 |
| -11 | 13.64 | 77.30 | 0.59 | 69.57 |
| -10 | 12.85 | 77.83 | 0.63 | 70.04 |
| -9 | 12.08 | 78.36 | 0.67 | 70.52 |
| -8 | 11.36 | 78.89 | 0.71 | 71.00 |
| -7 | 10.68 | 79.43 | 0.76 | 71.49 |
| -6 | 10.05 | 79.96 | 0.80 | 71.96 |
| -5 | 9.49 | 80.46 | 0.85 | 72.41 |
| -4 | 9.00 | 80.92 | 0.90 | 72.82 |
| -3 | 8.60 | 81.31 | 0.94 | 73.18 |
| -2 | 8.31 | 81.61 | 0.97 | 73.45 |
| -1 | 8.12 | 81.80 | 0.99 | 73.62 |
| 0 | 8.06 | 81.87 | 1.00 | 73.68 |
| 1 | 8.12 | 81.80 | 0.99 | 73.62 |
| 2 | 8.31 | 81.61 | 0.97 | 73.45 |
| 3 | 8.60 | 81.31 | 0.94 | 73.18 |
| 4 | 9.00 | 80.92 | 0.90 | 72.82 |
| 5 | 9.49 | 80.46 | 0.85 | 72.41 |
| 6 | 10.05 | 79.96 | 0.80 | 71.96 |
| 7 | 10.68 | 79.43 | 0.76 | 71.49 |
| 8 | 11.36 | 78.89 | 0.71 | 71.00 |
| 9 | 12.08 | 78.36 | 0.67 | 70.52 |
| 10 | 12.85 | 77.83 | 0.63 | 70.04 |
| 11 | 13.64 | 77.30 | 0.59 | 69.57 |
| 12 | 14.46 | 76.80 | 0.56 | 69.12 |
| 13 | 15.30 | 76.31 | 0.53 | 68.68 |
| 14 | 16.16 | 75.83 | 0.50 | 68.25 |
| 15 | 17.03 | 75.38 | 0.47 | 67.84 |
| 16 | 17.92 | 74.93 | 0.45 | 67.44 |
| 17 | 18.81 | 74.51 | 0.43 | 67.06 |

*Fig. 4*

MICROPHONE CALIBRATION SYSTEM

CROSS-REFERENCE TO PRIOR APPLICATIONS

This application is the U.S. National Phase application under 35 U.S.C. § 371 of International Application No. PCT/EP2018/078668, filed on Oct. 19, 2018, which claims the benefit of European Patent Application No. 17198793.6, filed on Oct. 27, 2017. These applications are hereby incorporated by reference herein.

FIELD OF THE INVENTION

The invention relates to a microphone calibration system, microphone calibration device, a lighting device, a microphone calibration method, a computer readable medium.

BACKGROUND

Lighting is more and more seen as an enabling platform for Internet of Things (IoT) applications enabling sensors to be hosted on this platform, for instance integrated in light poles, luminaires or lamps. Such a lighting based IoT platform could host many different sensors to provide IoT applications, e.g., microphones, particulate matter (PM) sensors, cameras and Wi-Fi sniffers, etc. IoT applications which could be enabled by these sensors could for example be sound monitoring, incident detection, air pollution detection and so forth.

For example, U.S. Pat. No. 9,615,066 B1, with title "Smart lighting and city sensor", and included herein by reference, discloses a street light enclosure mounted to a light pole. Amongst others, the street light enclosure comprises a microphone array, and a wireless transceiver. The microphone array can detect sound and direction of sound. This is useful, e.g., to detect gunshots. Moreover, the direction of the sound can be triangulated to pinpoint the position of a shooting. If the light poles are arranged sequential, the microphone arrays have high resolution and a combination of microphone data from an array of light poles on both sides of a street or freeway provides valuable information in detecting sources of sound.

For example, in the known system, the sound source may be a natural or an artificial sound generator. Examples of natural sounds include: human sounds, animal sounds, environmental sounds, etc. In this instance, a natural sound generator may be a human being, an animal, the environment, etc. An example of an artificial sound is a recorded sound, and an artificial sound generator may be a speaker. The sound wave generated from the sound source and propagated toward the sound direction detecting module may have a specific frequency and a certain volume.

However, a problem with the known system is that, in order to provide these applications, the sensor measurements require a high and constant accuracy. A microphone used to locate the origin of sound must be sufficiently accurately calibrated. In order to do so calibration is needed. These calibrations might need to be repeated multiple times to ensure accurate measurements throughout the lifetime of microphone. Calibration of a microphone, especially when installed in out-of-reach light poles is costly. Moreover, there are many light poles in a typically city, which makes regular calibration of the microphone sensor a costly proposition.

SUMMARY OF THE INVENTION

A microphone calibration system is proposed to automatically identify microphones which may need calibration. In an embodiment, a calibration is also automatically computed, and/or undertaken. This avoids the need of human calibration of microphones, which is an advantage, especially when microphones are integrated in high-mast luminaires. In the latter case calibration could be laborious and expensive.

The inventors had the insight that the ambient sounds which occur naturally in the surrounding area of microphone are suitable for calibration; for example if the microphone is located outside, say in a city, say along a road. A motorized vehicle, e.g., a car, which passes two or more microphones at a constant velocity, produces a more or less constant sound. However, if the two or more microphones do not measure the same sound level then one or more of them may need calibration. Various embodiments address various problems that may be encountered when exploiting this idea. For example, the measurement may be compared in various ways. For example, a specific sound measurement may be used, e.g., a local maximum, or an average over one or more measurements etc. These different options result in the computation of a sound profile which can be compared between microphones. Another problem that is addressed is that it is beneficial to the accuracy if it is avoided that erroneously different sounds are used for calibration, e.g., sounds that originated from different cars. For example, the sounds may be classified in various ways, and this classification may be used to determine which sound measurements may be used for calibration and which may not.

Interestingly, the calibration system may be implemented in a calibration device, e.g., which may receive measurements from multiple other microphones. The calibration device may also be implemented in a microphone, in which case, the calibration system receives measurements from other microphones in addition to the measurement done at that particular microphone. For example, in the former case, the calibration device may give a list of all microphones that need calibration. For example, in the latter case, the calibration in the microphone may report if that particular microphone needs calibration.

For example, in an embodiment, the calibration system is configured to detect from first sound measurements that a moving object passes a first microphone. If so, it is detected if a moving object also passes a second microphone. The second microphone may be selected from a list of microphones associated with the first microphone; typically these are microphones that are close or neighboring to the first microphone. A sound measurement is obtained from the second microphone, recording the passing of moving object. For example, the pair of measurements may be two sound recordings of each a few seconds long. At this point the calibration system may qualify the pair of measurements. For example, it may be tested if the time passed between recording the first sound clip and the second sound clip is compatible with a possible speed of the moving vehicle. For example, it may be tested if the two sounds clips have a similar frequency, etc. Once a suitable pair of sound recordings is obtained, a sound profile may be computed from them. For example, a sound profile may be sound pressure level, or an amplitude, e.g., the maximum in the measurements. For example, a sound profile may be multiple sound pressure levels, or amplitudes in the measurements. For example, a sound profile may be an average of multiple sound pressure levels, or amplitudes in the measurements, or even of the entire measurements. In an embodiment, multiple pairs of sound measurement are obtained and the sound profiles may be computed from the multiple pairs, e.g., the average over the multiple measurements, etc.

The microphones could be installed outside, e.g., in a city, along a road, etc. For example, the microphones may be integrated in city infrastructure, such as buildings, and bridges, etc. An aspect of the invention concerns a lighting device comprising a microphone. The microphone may be used for various applications, such as traffic management, incident recording, incident localization, etc., e.g., as indicated above. In an embodiment, the lighting device may comprise calibration functions. For example, in an embodiment the lighting device may be arranged to determine a need to calibrate if a difference between a first and second sound profile is beyond a threshold. The lighting device may comprise usual elements of lighting devices, such as, a light producing unit, e.g., an LED, a luminaire, and the like.

Like the microphones, also the lighting device may be arranged outside, e.g., in a city, along a road, etc. For example, the lighting device may be used for outdoor illumination. For example, the lighting device may be a traffic light. In an advantageous embodiment, the lighting device is a light pole. Light poles, especially if multiple light poles are arranged along a road, e.g., at a regular distance from each other, provide a good opportunity for calibration, since the lighting poles often receive comparable sounds, due to cars passing the light pole.

The calibration system, light pole, calibration device and microphones are electronic devices. For example, a calibration device may be a computer.

In an embodiment, the microphone calibration device is only operated whenever the multiple light poles are providing light. This may be advantagous for the accuracy of the measurements, because the light poles commonly provide light during nighttime, which nighttime is a suitable time for performing the calibration according to the invention, because less erroneos interference may be present from different sources of sound as less objects may be passing by and because less environmental activity (hence ambient sound) may be recorded during nighttime. For example, further, the light poles may be providing said light whenever triggered by presence, e.g. via a presence detection. Hence, the microphone calibration device according to the invention may be implemented in collaboration with a presence detector within the light pole, such that each time presence is detected, the microphone may be operated to measure said sound.

In an embodiment, the one or more processor circuit is further arranged to instruct the lighting device, i.e. e.g. the light pole, to emit (with its respective light source) a visual indicator upon determining the need to calibrate the first or second microphone. Such a visual indicator may be blinking, changing the light intensity, or turning a or a set of pixel(s) of the light source to another color or intensity. This may be advantagous to indicate which light pole comprises the microphone in need of calibration and/or the calibrated microphone.

In an embodiment, the one or more processor circuit is further arranged to switch off the respective microphone in need of calibration upon determining the need to calibrate the first of second microphone. Additionally, the one or more processor circuit may be arranged to send a notification message to an external device, such as a central server or mobile device, such that the switching off of the respective microphone is reported. This may facilitate maintenance activities. Moreover, taking out an erroneous microphone may facilitate and improve the accuracy of the analysis of the information received from the multiple microphones.

In an embodiment, the one or more processor circuit is further arranged to determine a geographical location of the first or second microphone if a difference between the first and second sound profile is beyond a threshold, i.e. upon determining the need to calibrate. This determination may for example be done by retrieving or polling the identifier or location of the light pole into which the microphone is comprised within.

In an embodiment, said microphones are being installed in the multiple light poles, wherein the orientation of the microphones are all in the same direction. For example, each light pole of the multiple light poles may comprise a microphone directed to one lane (or to the South). This may e.g. facilitate the accuracy of the present invention and/or classification according to the present invention, because this prevents more that erroneously different sounds are used for calibration. For example, a light pole may be at the center of the highway with an North-going lane and a South-going lane. Each light pole may have the microphone directed to the North-going lane, such that any confusion with sounds detected from the South-going lane is reduced.

A method according to the invention may be implemented on a computer as a computer implemented method, or in dedicated hardware, or in a combination of both. Executable code for a method according to the invention may be stored on a computer program product. Examples of computer program products include memory devices, optical storage devices, integrated circuits, servers, online software, etc. Preferably, the computer program product comprises non-transitory program code stored on a computer readable medium for performing a method according to the invention when said program product is executed on a computer.

In a preferred embodiment, the computer program comprises computer program code adapted to perform all the steps of a method according to the invention when the computer program is run on a computer. Preferably, the computer program is embodied on a computer readable medium.

BRIEF DESCRIPTION OF THE DRAWINGS

Further details, aspects, and embodiments of the invention will be described, by way of example only, with reference to the drawings. Elements in the figures are illustrated for simplicity and clarity and have not necessarily been drawn to scale. In the Figures, elements which correspond to elements already described may have the same reference numerals. In the drawings, FIG. 1 schematically shows an example of an embodiment of a microphone calibration system, FIGS. 2*a* and 2*b* schematically show an example of an embodiment of a microphone calibration system, FIG. 3*a* schematically shows an example of graph of a sound pressure level, FIG. 3*b* schematically shows an example of graph of a sound pressure level, FIG. 3*c* schematically shows an example of graph of amplitude, FIG. 4 schematically shows an example of values in FIGS. 3*a*, 3*b* and 3*c*

LIST OF REFERENCE NUMERALS

Figure 1:
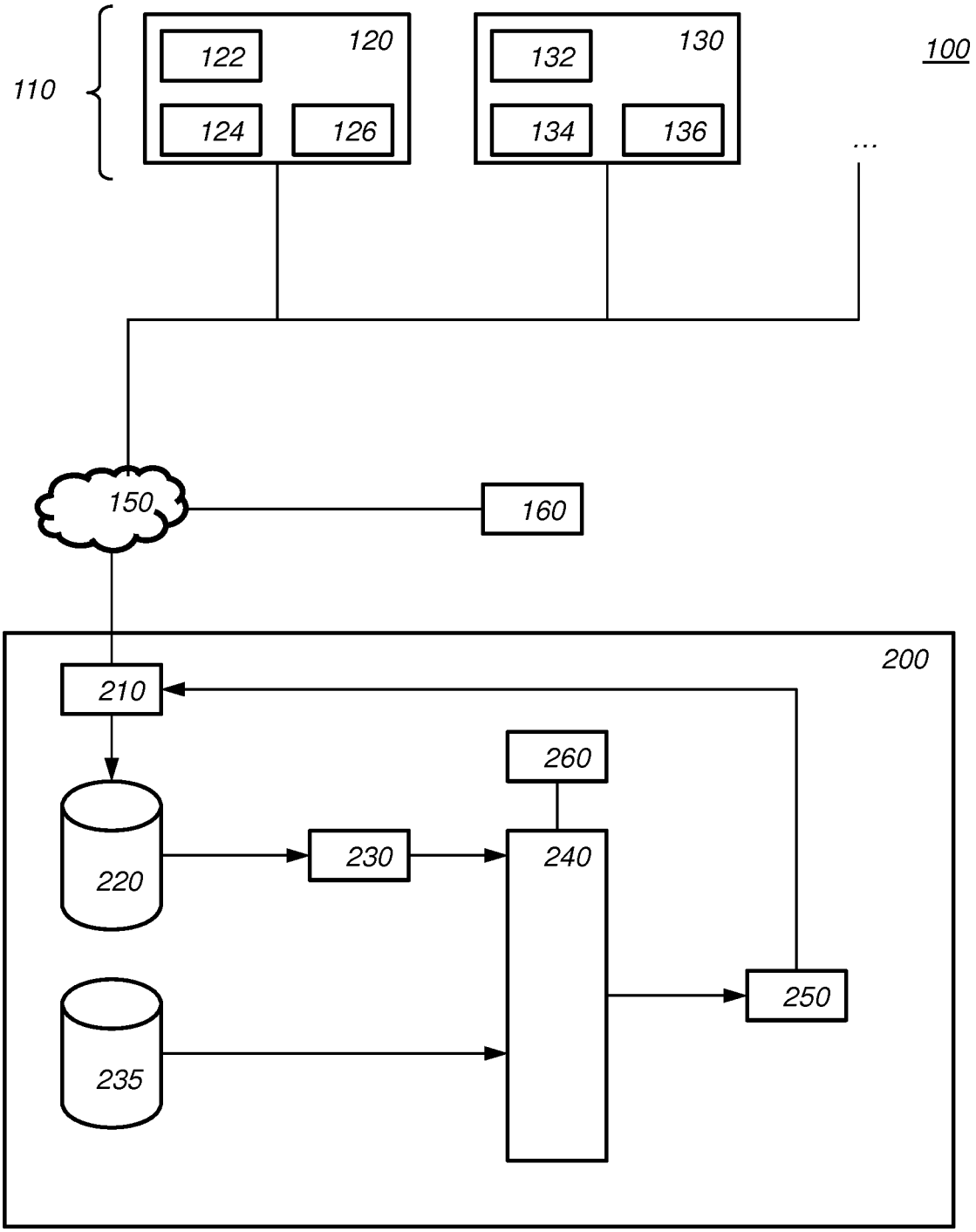

100 a microphone system
110 multiple microphones

120 a first microphone
130 a second microphone
122, 132 a communication interface
124, 134 a microphone sensor
126, 136 a controller
150 a digital communication network
160 an application unit
200 a calibration device
210 a communication interface
220 a sound measurement storage
230 a sound profile unit
235 a historic sound profile storage
240 a comparison unit
250 a calibration unit
260 a classification unit
300 a microphone calibration system
310 a car
322, 324 a light pole
1000 a computer readable medium
1010 a writable part
1020 a computer program
1110 integrated circuit(s)
1120 a processing unit
1122 a memory
1124 a dedicated integrated circuit
1126 a communication element
1130 an interconnect
1140 a processor system

DETAILED DESCRIPTION OF PREFERRED EMBODIMENTS

While this invention is susceptible of embodiment in many different forms, there are shown in the drawings and will herein be described in detail one or more specific embodiments, with the understanding that the present disclosure is to be considered as exemplary of the principles of the invention and not intended to limit the invention to the specific embodiments shown and described.

In the following, for the sake of understanding, elements of embodiments are described in operation. However, it will be apparent that the respective elements are arranged to perform the functions being described as performed by them.

Further, the invention is not limited to the embodiments, and the invention lies in each and every novel feature or combination of features described herein or recited in mutually different dependent claims.

FIG. 1 schematically shows an example of an embodiment of a microphone calibration system in the form of a calibration device 200. FIG. 1 further shows a microphone system 100 comprising the calibration device 200.

System 100 comprises multiple microphones 110. FIG. 1 shows two microphones of the multiple microphones: microphone 120 and microphone 130. Microphones 110 are arranged in an area in which moving objects pass the microphones. For example, microphones 110 are arranged in a city, in which motorized vehicles pass the microphones. For example, the microphones 110 are arranged alongside roads in a city or alongside a freeway. For example, the microphones may be integrated in lighting devices, such as light poles, traffic lights, and the like. One or more or all of the microphones 110 may also be installed on their own, e.g., freestanding, e.g., without integration in a light pole. Microphones 110 may be combined with other sensors, e.g., camera's, e.g., PM sensors, and the like. A microphone may be a microphone array.

In FIG. 1, the microphones comprise a communication interface; shown are communications interfaces 122 and 132. Calibration device 200 comprises a communication interface 210. The various devices of system 100 communicate with each other over a computer network 150. The computer network may be an internet, an intranet, a LAN, a WLAN, etc. Computer network 150 may be the Internet. The computer network may be wholly or partly wired, and/or wholly or partly wireless. For example, the computer network may comprise Ethernet connections. For example, the computer network may comprise wireless connections, such as Wi-Fi, ZigBee, and the like. The devices comprise a connection interface which is arranged to communicate with other devices of system 100 as needed. For example, the connection interface may comprise a connector, e.g., a wired connector, e.g., an Ethernet connector, or a wireless connector, e.g., an antenna, e.g., a Wi-Fi, 4G or 5G antenna. For example, microphones 110, and calibration device 200 may comprise communication interfaces 122, 132 and 210 respectively. Computer network 150 may comprise additional elements, which are not separately shown in FIG. 1, e.g., a router, a hub, etc. In microphone system 100, the communication interfaces may be used to send or receive measurements, e.g., sound measurements done by the microphones, or to send or receive processed measurements, e.g., sound profiles, or to send or receive other data, e.g., calibration data. Messages exchanged over network 150 may be digital messages, e.g., send and received in electronic form.

The microphones 110 may also comprise a microphone sensor, e.g., arranged to perform the sound measurement. For example, shown in FIG. 1 are microphone sensor 124 and microphone sensor 134 in microphones 120 and 130 respectively.

The microphones 110 may also comprise a controller, e.g., arranged to obtain the sound measurement from the sound sensor and to forward it to calibration device 200. For example, the controller may temporarily buffer the sound measurement. The controller may also send the sound measurements to some application unit 160. For example, application unit 160 may use sounds measurement to locate gunshots, etc. Known implementations may be used for application unit 160. A controller of a microphone may also perform part of the processing needed for the calibration. In an embodiment, computing a sound profile may be done in the microphone by the controller. This significantly reduces overhead on the network.

In an embodiment, calibration device 200 comprises a sound measurement storage 220 and a sound profile unit 230.

The execution of the calibration device 200 is implemented in a processor circuit, examples of which are shown herein. FIG. 1 shows functional units that may be functional units of the processor circuit. For example, FIG. 1 may be used as a blueprint of a possible functional organization of the processor circuit of calibration device 200. The processor circuit is not shown separate from the units in FIG. 1. For example, the functional units shown in FIG. 1 may be wholly or partially be implemented in computer instructions that are stored at device 200, e.g., in an electronic memory of device 200, and are executable by a microprocessor of device 200. In hybrid embodiments, functional units are implemented partially in hardware, e.g., as coprocessors, e.g., sound coprocessors, and partially in software stored and executed on device 200.

Sound measurement storage 220 may be configured to store sound measurements from multiple microphones 110. For example, sound measurement storage 220 may comprise sound recordings from a period, e.g., a recent period, such as the last hour, etc. Sound measurement storage 220 may be used for longer term storage, possibly in the form of samples of the sound measurements, e.g., audio recording of the microphones. This is not necessary though, in an embodiment, sound measurement storage 220 is configured to buffer the sound measurements so that sound profile unit 230 can compute sound profiles for the microphones. The sound profiles may be stored in sound measurement storage 220 as well or instead of the measurements themselves.

In an embodiment, calibration device 200 obtains a first ambient sound measurement and a second ambient sound measurement of a moving object as it passes the first microphone 120 and the second microphone 130. Note that it is not necessary that a controlled sound is produced near the microphones. Rather the natural ambient sound is used to calibrate the microphones.

Sound profile unit 230 is configured to compute a sound profiles for the microphones. The sound profiles are indicative of a calibration of the first and second microphones. In other words, given sound profiles and knowledge of the sound source information on the calibration of the microphone would be obtained. Typically, no knowledge of the sound source is available though. Nevertheless, the sound profiles give valuable information that may be exploited to obtain information on the calibration of the microphones. In particular, sound profile unit 230 is configured to compute a first and second sound profile from the first and second sound measurements. In an embodiment, computing the sound profile is left to the microphones. In that case, calibration device 200 may be configured to obtain, e.g., receive sound profiles from the microphones rather than raw measurements themselves.

Generally speaking there are a number of ways to select sound to compute profiles from. In a first approach, the sound profile is computed over a larger period of time, e.g., as an average of the sound sensed at a microphone. In a second approach, an average is computed over a larger amount of sound recording, but some parts are discarded. For example, sounds recorded during windy weather, rain, fog, etc., and other conditions that may affect the microphones are not taken into account to compute the difference. In yet, a further refinement, the system removes from consideration all recorded sound which does not correspond to a passing motorized vehicles, e.g., a car. For some microphones, there may be large stretches of time in which no interesting sound is recorded. By ignoring these stretches a better profile is obtained. In yet a further refinement, the system tries to select pairs of sound clips at two microphones that correspond to the same motorized vehicle, e.g., car passing, preferably at the same speed. Such a single pair could be used to determine a calibration need from, but in an embodiment, more than one, of such pairs are averaged to obtain the profile.

An example of a sound profile is the average sound level over a time period. For example, this may be the average sound pressure level, e.g., in dB, e.g., the average amplitude. For example, a microphone sensor may be arranged to report sound amplitude in digital values, e.g., in 16-bit values. For example, the average sound level for microphone 120 and for 130 may be computed by sound profile unit 230. There are other sound profiles, some of which are discussed herein. In an embodiment, a sound profile comprises an amplitude or sound pressure level, or the average over multiple amplitude or sound pressure levels. An amplitude may be the digital output of a microphone sensor, e.g., of a corresponding analog to digital converter.

Calibration device 200 comprises a comparison unit 240. In an embodiment, comparison unit 240 may use the sound profiles to determine a need for calibration directly. For example, if the microphones are arranged along the same street, and experience the same traffic, which drives at a comparatively constant speed, then the sound profiles are expected to be comparatively equal. If the sound profiles do differ more than a threshold, then this is an indication that one of the two microphones may need calibration. Pinpointing, even to a level of a few microphones, which may need to be calibrated is an advantage over the known system, in which calibration requires calibrating every device. Whereas using the comparison unit 240, the number of microphones to calibrate may be reduced.

In general, when two sound profiles need to be compared, they can be subtracted. If a sound profile comprises multiple values, then the corresponding values may be subtracted. If a sound profile contains a single value, then the difference of this single value may be compared to a threshold. Instead of subtracting, the values may also be divided. The result may be compared to a threshold. If the difference of quotient exceeds a threshold, then calibration may be warranted. The threshold may be two-sided, e.g., the difference or quotient should not be larger than some first value nor smaller than some second value, etc. If a profile has multiple values, the corresponding values in the profile may be compared. In this case, one may compare the threshold with the largest difference, accumulated differences, e.g., an integral, or the average difference, etc.

For example, if the sound profiles are the average sound level, e.g., sound pressure level, over a period, e.g., over a period of days or weeks, etc., then the two averages may be compared to each other, e.g., by subtracting, dividing, etc., and comparing the result with a threshold. Unless, it is clear from the context, we will assume profiles to be a single number; however it is understood that such embodiments may be extended to multiple values in the above manner.

Direct comparison of two profiles works best if the two microphones and the traffic noise that they receive are highly comparable. This may be the case for microphones arranged along a street. For example, the microphones may be arranged in a pole, e.g., a light pole, of the same height, and same distance to the street. Even in this case, the noise will not be identical, for example, a car may increase or decrease its speed. However, these differences are expected to average out in the long run, especially along a freeway not too close to an exit. In any case, using this direct method calibration defects can be detected which are larger than noise variations. For example, a broken or nearly broken microphone may be detected. In this case, rather than calibration in the strict sense the microphone or microphone sensor may be replaced by a calibrated microphone or microphone sensor.

However, the method can also be used in less ideal circumstances. For example, in an embodiment, the difference is compared to an historic difference, the need to calibrate being detected if the difference increased or decreased beyond a threshold. For example, the difference may be larger than a threshold, and/or lower than another threshold. For example, the absolute difference may be larger than a threshold. For example, after installation, or after a calibration, the system may record sound measurements, or sound profiles computed therefrom and store them. For example, they may be stored together with an identifier of the microphone. For example, the historic reference measurements or profile may extend over a similar period of time as the actual measurement. Calibration device 200 may comprise an optional historic sound profile storage 235 for storing these historic values.

For example, suppose microphones i and j have current sound profiles $x_i$ and $x_j$, and historic sound profiles $y_i$ and $y_j$, e.g., stored in storage 235, in this case comparison unit 240 may compute $(x_i-x_j)-(y_i-y_j)$. Other types of comparison may be used here as well, e.g., $(x_i-x_j)/(y_i-y_j)$, e.g., $(x_i/x_j)/(y_i/y_j)$, etc. As above with the direct comparison, the comparison with a historic value, e.g., a reference value, may be compared with a threshold, or a two-sided threshold etc. An advantage of this approach is that even if the traffic or the placing of the microphones, etc., is not entirely comparable, it is still detected if historic differences fail to hold up. For example, if the difference between two microphones is growing or decreasing, this may be an indication that one of the two needs calibration, especially if this is seen over longer periods. For example, microphone calibration may be done yearly, or every two years, etc., In this case, one could use, e.g., a period of a year, a half year etc. to compute the historic profile and/or the current profile.

Calibration may be done by calibration personnel, e.g., on site. However, in an embodiment, the calibration system 200 comprises an optional calibration unit 250. For example, the microphones may have corresponding calibration data. The calibration data may be stored at the microphone, or may be stored elsewhere, e.g., in application unit 160, or at a further controller not separately shown in FIG. 1, etc. The calibration unit 250 is configured to compute new calibration data for the first or second microphone to decrease the difference between their sound profiles. For example, the calibration data may be the parameters that are used in a calibration formula that is applied to raw measurement data, e.g., the calibration formula may be a linear transformation, or an affine transformation, or a polynomial transformation, etc., of the output of the microphone sensor, or of an analog to digital conversion etc. For example, the calibration may be factor which with microphone sensor data, or microphone data is multiplied. The factor may be 1, in case the microphone may not need further calibration, but may also be larger or smaller than 1. For example, in case of the direct method the factor calibration data $r=x_i/x_j$, in this case the calibration data is for microphone j. Note that applying the calibration will move the sound profiles closer together, and will increase or decrease the output of or both of them, but this does not mean that the microphones give identical data. After computing calibration data, the calibration data may be uploaded to the corresponding microphone or to any other device that needs it, e.g., application unit 160.

If only the measurement data of two microphones is compared, it may be hard to determine which of the two microphones needs calibration. Either one has become louder, e.g., through a defect in its shielding, or the other has become less loud, e.g., through a defect in its sensor, etc.; there are many ways in which a microphone may malfunction. In some case, application knowledge may resolve this; for example, it may be known that microphones in a certain system always become less loud with age. In this case, the less loud microphone can be calibrated, e.g., having the lower sound profile.

However, other microphones may also be used to pinpoint the problematic microphone. For example, in an embodiment, multiple microphone measurements are used to determine which microphone needs calibration. For example, in an embodiment, a third ambient sound measurement is performed of the moving object as it passes a third microphone. From this measurement, a third sound profile is computed. In this case, the comparison unit 240 may determine a need to calibrate the first microphone if a difference between the first and second sound profile is beyond a threshold, but a difference between the second and third sound profile is within a threshold. For example, if the sound profiles are scalars, $x_1$, $x_2$ and $x_3$ then an embodiment may determine that $|x_1-x_2|>T_1$ and $|x_2-x_3|<T_2$, for thresholds $T_1$ and $T_2$. The size of the thresholds may be determined empirically.

This method may also use historic data as indicated above. In other words if two microphones are still close to each other, e.g., as they were after a previous calibration, but another microphone diverges from at least one of them, then it is the latter.

Calibration device 200 may optionally comprise a classification unit 260. The classification unit 260 identifies the type of sounds, and may also determine the suitability of a particular sound for purposes of determining a calibration need. For example, classification unit 260 may identify unsuitable sounds and leave them from consideration; for example such sounds are not taken into account to compute a sound profile. Another advantage of classification unit 260 is that it may identify that a particular sound at a first microphone corresponds to a particular sound at a second microphone. This identification may be done at the same point in time, but preferably is done when the sound moved from a position near the first microphone to a comparable position near the second microphone.

For example, in an embodiment, the classification unit 260 is configured to classify a sound recorded by a microphone as a moving object, more in particular as a motorized type of moving object. Sounds that do not correspond to a motorized type of moving object may be discarded. Interestingly, the classification unit 260 may actively search for, or assist in a search for a pair of a first ambient sound measurement, e.g., in a first time period, at a first microphone, and a second ambient sound measurement, e.g., in a second time period, at a second microphone. In this case, it is the intention that the first and second measurement correspond to the same moving vehicle. For example, the classification unit 260 may classify a sound measurement in a more detailed fashion, e.g., estimating the type of motorized vehicle, e.g., car or motorcycle, estimating the size of its motor, and even estimating the model of a car, etc. If two pairs of sound measurements do not have the same classification, e.g., one is a car the other a motorcycle, then they are discarded. Furthermore, the time periods in which the two sounds are recorded should be compatible with a moving car. For example, the time a car needs to pass a microphone, or to move from a first to a second microphone may be estimated, which may be done in advance, and compared to the time periods at which the sound measurements were taken.

For example, classification may be done by classifying a frequency profile of a sound. The frequency distributions may also be directly compared. For example, a frequency distribution of the first ambient sound measurement and the second ambient sound measurement may be compared. The pair of ambient sound measurements may be discarded if the frequency distributions differ beyond a threshold. For example, the frequency distributions may be subtracted from each other, and individual frequency differences may be compared to a threshold. For example, the frequency distributions may be obtained by Fourier analysis. For example, the Fourier analysis may be further processed, e.g., by discarding high frequency components, e.g., a low-pass filter.

Interestingly, the sound measurements may include both the sound of a moving object, say a car, approaching the microphone and receding from the microphone. The frequency distributions may be compared separately for the approaching parts of the sound profiles as for the receding parts of the sound profiles. A frequency difference between the approaching and receding sound may be computed and from this the speed of the vehicle may be estimated, e.g., using the Doppler shift. If the speed of the vehicle changed between the first and second microphone, then the sounds are discarded, as a change in speed likely implies a change in volume. Selecting corresponding pairs of sound recordings increases the accuracy of the system.

For example, in an embodiment to compare a first microphone and a second microphone a large number of sound recording pairs may be recorded. Each pair comprises a sound recording from the first microphone and a sound recording from the second microphone. According to the classification each recording in the same pair corresponds to the same vehicle, preferably driving at the same speed. Recordings that were recorded during unfavorable weather conditions may be discarded. The recordings in the pairs that correspond to the first microphone are used to compute the first sound profile, e.g., by averaging the sound levels. The recordings in the pairs that correspond to the second microphone are used to compute the second sound profile, e.g., by averaging the sound levels. The recording may be a few seconds long, e.g., varying from 0.5 seconds to 3 seconds. The number of pairs may be 10 or more, 100 or more, etc.

The calibration device 200 may be distributed rather than concentrated in a single device. The various units may be installed in different devices, e.g., communicating over the digital network 150. For example, the storage may be cloud storage. For example, the calibration device may be a calibration system which is implemented in multiple devices. In particular, the multiple devices may be lighting poles.

For example, in an embodiment, a light pole or poles are used to implement the calibration system. In an embodiment, a light pole comprises a microphone, said microphone being arranged in an area in which moving objects pass the microphones. The microphone may cover the same or overlap with an area that is illuminated by the light pole. The pole comprises a communication interface arranged to communicate with one or more other light poles of the multiple microphones. The communication interface may also be used to include the pole in a smart lighting system. For example, the pole may receive commands to turn on or off over the communication interface, etc. The pole comprises a processor circuit arranged to perform a first ambient sound measurement a moving object as it passes the microphone. There is no need for the pole to receive this measurement from another source. The pole, may also compute a first sound profile from said first sound measurements, said first sound profiles being indicative of a calibration of the first microphone. On the other hand, the pole may be arranged to receive a second profile from the other lighting pole, said second profile being indicative of a calibration of a microphone of the other light pole. The second pole may be located near, or next to, this pole. The two poles may thus communicate which each other to calibrate themselves. Finally, the pole determines a need to calibrate the first or second microphone if a difference between the first and second sound profile is beyond a threshold. The second profile may be computed at this pole or at the other pole. The pole may communicate with other poles to obtain a more accurate estimate of the required calibration or of a more accurate estimation which pole needs to calibrate.

In the various embodiments of the calibration system or calibration device, the communication interface may be selected from various alternatives. For example, the interface may be a network interface to a local or wide area network, e.g., the Internet, a storage interface to an internal or external data storage, an application interface (API), etc.

The calibration system or calibration device may have a user interface, which may include well-known elements such as one or more buttons, a keyboard, display, touch screen, etc. The user interface may be arranged for accommodating user interaction for performing a calibration action, e.g., to query the system to display all microphone that need manual calibration, or to show all microphones for which calibration is most urgent, e.g., because they show the largest difference in sound profile, or initiate the computation of calibration data for calibration correction, etc.

Storage in the calibration system, e.g., storage 220 or storage 235 may be implemented as an electronic memory, say a flash memory, or magnetic memory, say hard disk or the like. The storage may comprise multiple discrete memories together making up the storage. The storage may also include cloud storage, e.g., for all or part of storage 220 or storage 235, etc.

Typically, the calibration system, e.g., calibration device 200 comprises a microprocessor (not separately shown in FIG. 1) which executes appropriate software stored at the calibration system, e.g., calibration device 200; for example, that software may have been downloaded and/or stored in a corresponding memory, e.g., a volatile memory such as RAM or a non-volatile memory such as Flash (not separately shown). The microphone devices 120 and 130 may also be equipped with microprocessors and memories (not separately shown in FIG. 1). Alternatively, the calibration system, e.g., calibration device 200 may, in whole or in part, be implemented in programmable logic, e.g., as field-programmable gate array (FPGA). The calibration system, e.g., calibration device 200 may be implemented, in whole or in part, as a so-called application-specific integrated circuit (ASIC), i.e. an integrated circuit (IC) customized for their particular use. For example, the circuits may be implemented in CMOS, e.g., using a hardware description language such as Verilog, VHDL etc.

In an embodiment, a calibration system, e.g., calibration device 200 may comprise a sound profile circuit, a comparison circuit, a calibration circuit, a classification circuit, etc. The circuits implement the corresponding units described herein. The circuits may be a processor circuit and storage circuit, the processor circuit executing instructions represented electronically in the storage circuits.

A processor circuit may be implemented in a distributed fashion, e.g., as multiple sub-processor circuits. A storage may be distributed over multiple distributed sub-storages. Part or all of the memory may be an electronic memory, magnetic memory, etc. For example, the storage may have volatile and a non-volatile part. Part of the storage may be read-only.

Figure 2A:
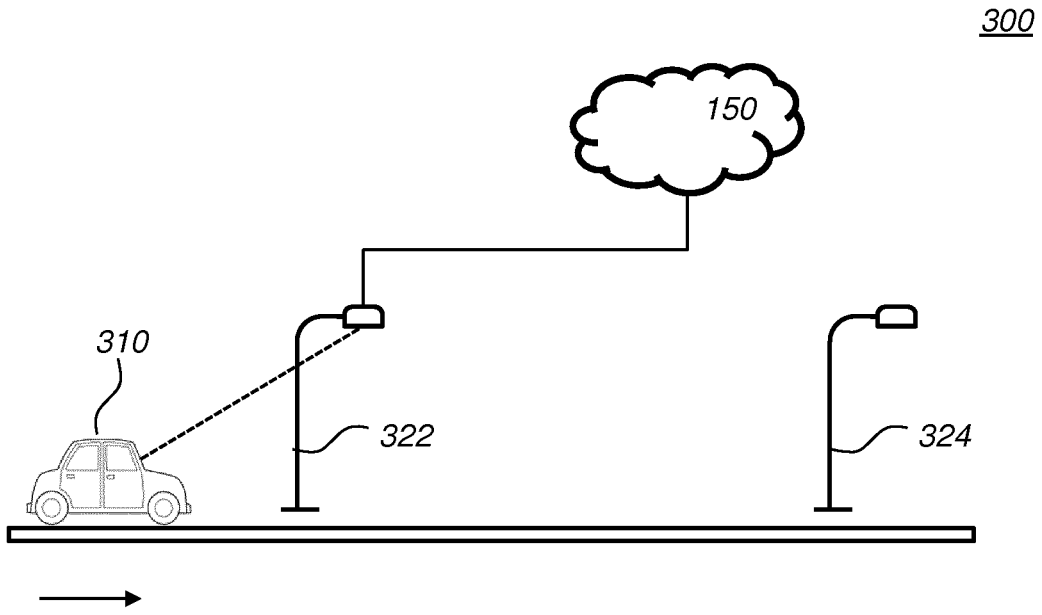
Figure 2B:
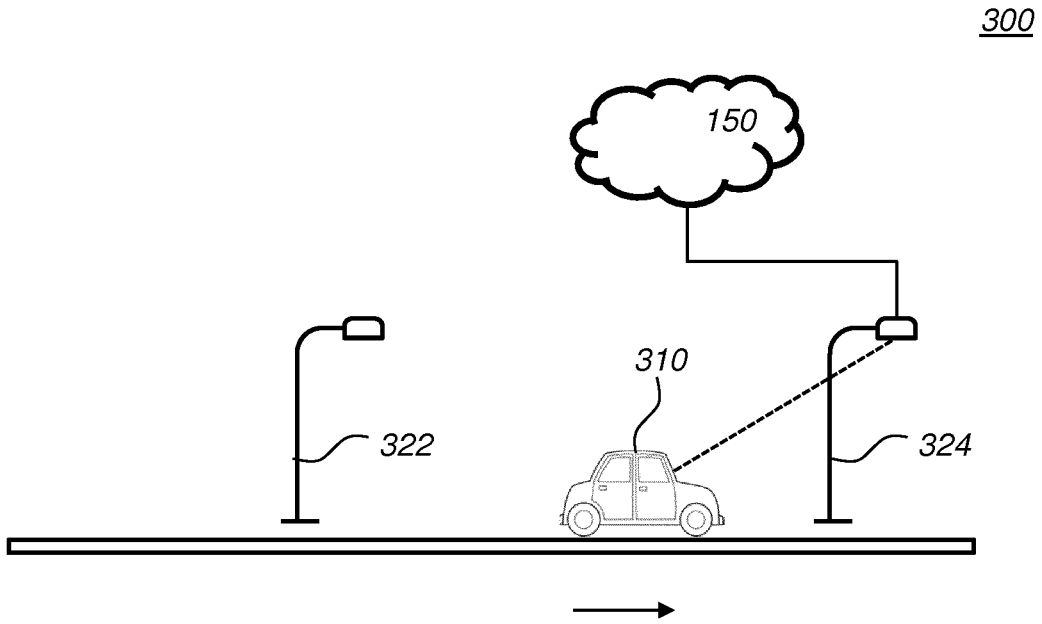

FIGS. 2*a* and 2*b* schematically show an example of an embodiment of a microphone calibration system. Shown in the figures is a car 310 and lighting poles 322 and 324. A microphone is integrated in each of the lighting poles. The microphone systems described with reference to FIG. 1 may, for example, be installed in the system 300. The arrow below the figures indicates the direction of driving of car 310. The light poles are connected, e.g., as part of a connected lighting system. For example, the lighting system may be connected to each other or connected to a back-end system, which may include a calibration device 200. FIG. 2*a* shows car 310 approaching pole 322, and pole 322 connecting with digital network 150. FIG. 2*b* shows car 310 approaching pole 324, and pole 324 connecting with digital network 150.

For example, microphone 322 may forward a sound measurement of car 310 as it passes microphone 322, or may compute a sound profile of the sound measurement and forward the sound profile. For example, microphone 322 may forward toward a back-end system, e.g., a back-end system such as calibration device 200; for example, microphone 322 may forward to microphone 324. Microphone 324 may be a neighboring microphone along the road. For example, which microphones are neighboring may be predetermined, it may also be determined by the calibration systems, either locally or in a back-end, e.g., from geographic information, e.g., coordinates, e.g., from a map; it may also be determined from a high similarity in sound measurements.

For example, microphone 324 may register the same sound that was picked up by the previous sensor and uses the measurement value as a reference to calibrate its own measurement value. For example, microphone 324 may determine that the sound it measures probably originates from the same car, e.g., because it is a similar sound, but it may be more or less loud. For example, car 310 may be measured as 72 dB at pole 322 but at 65 dB at pole 324. This may be corrected by calibrating pole 324.

For example, microphone 322 may detect a passing vehicle, record its sound and forward the measurement to a back end calibration device, or, e.g., to microphone 324. In an embodiment, microphone 322 computes a sound profile or partial profile and forwards the profile, possibly together with classification information, e.g., type of vehicle, frequency information, etc. In the latter case, the sound measurements do not need to be forwarded which saves both bandwidth and it preserves privacy, yet pole 324 can still qualify if its measurement is from the same vehicle.

In an embodiment, the system calibrates microphones based on detection of moving objects with constant sound profiles. For example, the system may automate the calibration of microphones which may or may not be part of a lighting infrastructure. In an embodiment, the luminaires and their sensors are part of a connected network; so that, e.g., measurement and detections performed by one sensor can be communicated to other luminaires. Other, e.g., neighboring, light points can use the measurement values and detection as a reference to calibrate their own measurement values and in addition possibly remove noise from the detected sounds. In order to improve calibration, contextual information can be brought in, e.g., the system can be commissioned in such a way that no calibration will take place in case of rain, snow or fog, because these affect microphone performance. In addition, other contextual information can be brought in as well to ensure correct calibration and further increase accuracy of the calibration. For instance the data potentially available from the municipality, such as pole location, height, distance to road, overhang can be brought in.

In an embodiment, a microphone system comprises multiple microphone sensors that are part of a connected system, e.g., leveraging a connected lighting infrastructure. These microphone sensors allow, e.g., for measurement of sound levels or detection and tagging or classification of sound sources. The microphone may work in combination with other sensors.

For example, returning to FIGS. 2*a* and 2*b*. The sound level of the car passing pole 322 may be measured by the microphone sensor that is part of the lighting infrastructure. Microphones could also be installed separate without integrating in a light pole. Suppose for example, that a sound level of 72 dB is measured at pole 322. A next step may be that the object producing the sound is classified; in this example the object is tagged as a car, with designation XYZ. If the object were tagged as a non-motorized vehicle, e.g., a bike, the sound may be ignored altogether. Next the neighboring microphone sensor in pole 324 measures a sound level as well; in addition the object producing the sound may be classified or matched with the sound measured by the previous light pole 322.

As a next step, e.g., in the cloud, or through a local mesh, etc., the neighboring microphone sensor may cross-reference its measurement with the measurement of another sensor, e.g., of pole 322, and determine that the measurement of the second microphone is not correct and therefore needs to be re-calibrated. In addition, when a reference sound is available also noise that might blur the measurement could be removed from the sound measurements.

If the neighboring microphone sensor, e.g., as known from municipality database, is located further from the road, is mounted on a higher pole, or has a specific overhang, the sound calibration can be adapted based on these contextual characteristics. For example, from the contextual information, it may be calculated that the sound of a second pole would be expected to have different loudness level. The system can correct for that difference.

Note that the calibration does not have to take place continuously. For example, calibration is only needed every×mins/days/weeks. For example, calibration urgency may be dependent on the use case or the application, etc. This allows for a situation in which certain conditions can be put into place in order to allow for a calibration.

In an embodiment, second measurements may be ignored if they are off by a certain percentage. In order to increase accuracy and reliability of the system, 'strange' measurements could be ignored. This helps to ignore a case, in which a user sped up his car. Another option to deal with this could be to leverage the fact that there is a connected network, e.g., measuring nodes can communicate with one another and are also able to determine the exact time at which a certain measurement took place. If the time is x % higher/lower than the overall average this would mean that the object either has decelerated/accelerated. A filtering rule could be to ignore these types of objects from the calibration scheme. Moreover, this information in itself could serve other purposes, e.g., traffic management and optimization.

Yet another way to deal with vehicles that change its speed would be to only perform the calibration at times during the day (e.g. through using data from traffic management systems) when traffic is constant and no accelerations/decelerations are expected. For example, in rush hour a constant flow might be expected. For example, a filtering rule may require that a traffic light has been green for a particular number of seconds, since then traffic is assumed to be constant and therefore suitable for calibration; for example, the number of seconds may be determined empirically. Another option would be to use connected vehicles, which can give information on their speed, or, e.g., their engine characteristics. Even if only some trucks give this information, that may be enough for calibration purposes. For example, a vehicle may report speed to the calibration device, e.g., through a pole, or through network 150, etc. The speed may be used to discard measurements that correspond to different speeds.

As noted above, a single pair of measurements may not be enough to pinpoint which of the two microphones may need calibration. However, continuous measurements can take place over multiple (>2) measurement nodes. For instance if 4 out of 5 measurements are continuously +4 dB higher compared to the measurements coming from one node it would be safe to assume that the individual node should be re-adjusted/calibrated.

Figure 3A:
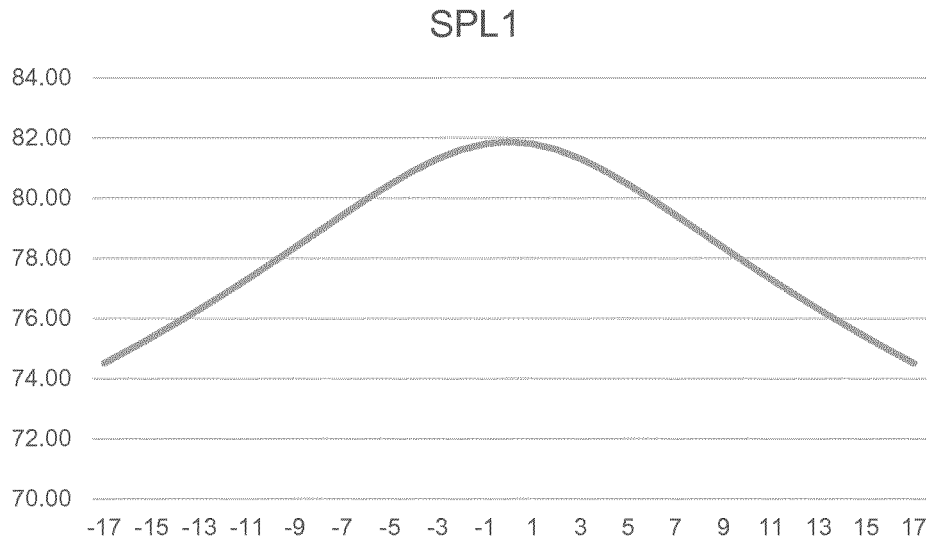

FIG. 3*a* schematically shows an example of graph of a sound pressure level. The graph corresponds to a simulation sound pressure level (SPL) of a moving object passing a light pole located near a road, wherein the microphone is integrated at the top of the pole. The vertical axis shows sound pressure level in dB. The horizontal axis show distance along the road past the pole. Instead of distance from the pole, a similar graph would be obtained if sound pressure level were graphed against time, assuming the moving object drives at a constant speed.

For example, a sound profile may be obtained from the measurement shown in FIG. 3*a* in various ways. For example, a local maximum may be identified in FIG. 3*a*. In this case the local maximum is at the 0 meter point. The local maximum may be taken as the sound profile. One may also take a measurement around the local maximum. For example, the sound measurement may be taken some number of second before and/or some number of seconds after the local maximum. For example, the number of seconds may be 2 seconds, etc.

The sound profile may be obtained by averaging the entire measurement, e.g., an entire sound recording of passing vehicle. The sound profile may be obtained by selecting individual points in the measurement, e.g., the local maximum, and the SPL at 1 second before and after the local maximum.

Figure 3B:
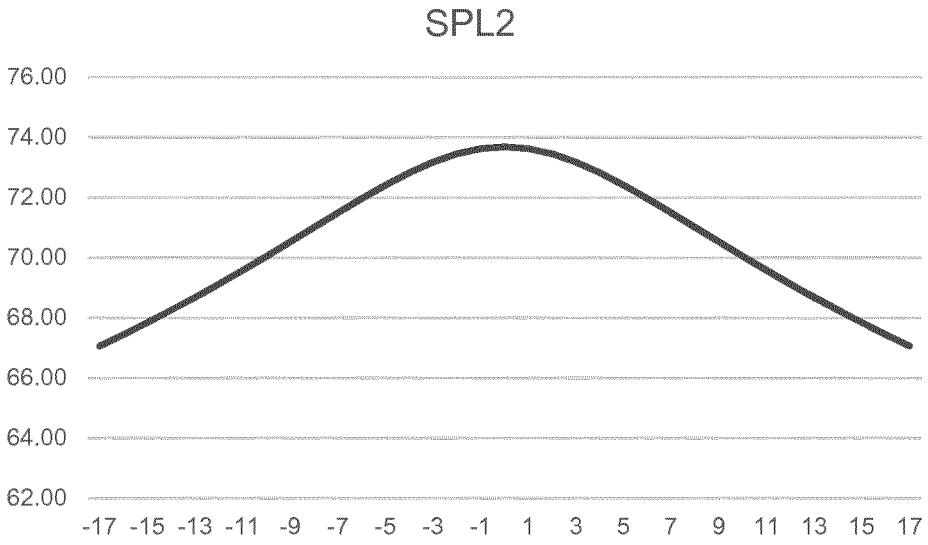

FIG. 3*b* schematically shows an example of graph of a sound pressure level at a neighboring pole. The sound pressure level at this microphone has dropped. For example, historic data may show that these microphones were initially, equal or nearly so. In the measurements of this pole, also a local maximum may be identified, and a measurement of similar or the same size may be taken as for the pole of FIG. 3*a*. The sound profiles of the two measurements may be compared to determine if any of the two corresponding microphones need calibration. Additional processing may be done to make sure these two measurements belong to each other. For example, the relative timing between the local maxima should be compatible with the distance between the two microphones and the normal speed along that road. For example, one may discard the pair of measurements if the times their local maxima occurred differ more than a threshold, or differ less than a threshold. For example, in some situations they may be discarded if they differ less than 1 second, or if they differ more than 4 seconds etc. The two pairs may also be qualified based on a frequency analysis, see above. The pair may also be qualified based on the relative sound levels. If the sound level of any of the two is too little, it may indicate that this was not a motorized vehicle. However, if one of the two microphones systematically gives low sound levels, this may indicate that the microphone is broken.

Figure 3C:
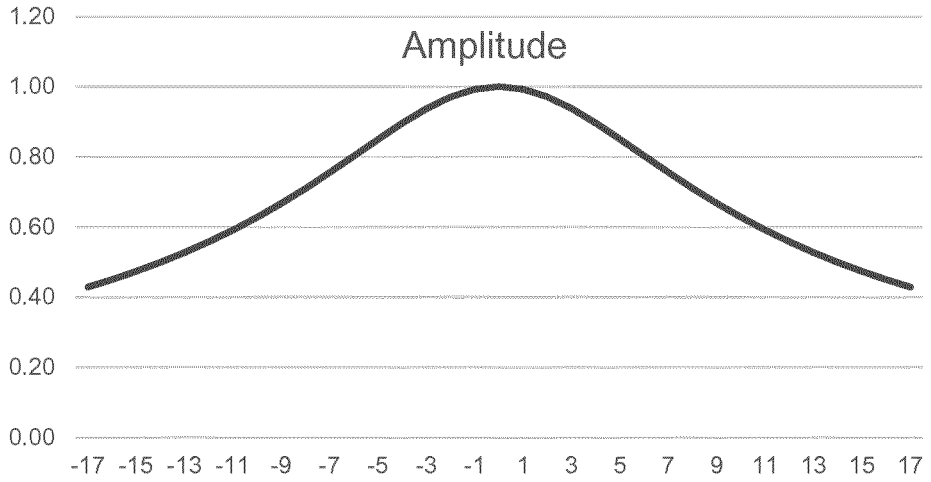

FIG. 3*c* schematically shows an example of a graph of measurement amplitude corresponding to the graph of FIG. 3*a*. Instead of computing sound pressure levels, e.g., in dB, sound profiles may also be directly computed from the amplitude of the signal after analog to digital conversion of the microphone sensor output. As can be seen from the graph in FIG. 3*c* this gives similar results. For example, a local maximum in amplitude rather than in sound pressure level may be computed, etc.

FIG. 4 schematically shows an example of values in FIGS. 3*a*, 3*b* and 3*c*. The first column indicates the distance of the moving vehicle along the road. Dist indicates the distance from the vehicle to the microphone. It is assumed that the vehicle is closest to the microphone when the vehicle is at point 0 of the road. SPL1 is the sound pressure level at a pole 1. SPL2 is the sound pressure level at a pole 2. Distance along the road is computed with the pole as reference. This means that point 0 is a different point on the road for pole 1 than for pole 2. Amplitude is the ratio between amplitude outputted and the maximum amplitude. This number is only shown for pole 1.

For example, in an embodiment, the sound profile for the first pole may be the value 81.87 and for the second pole the value 73.68 since these are the maximum SPL values measured as the car passes. For example, in an embodiment, the sound profile may be the values (75.83, 81.87, 75.83) for the first pole, as these correspond to the SPL value at 1 second before and after the local maximum. This assumes the vehicle moves at 14 meter per second. In an embodiment, the sound profile may be the average, e.g., from x=−14 up to x=+14. In an embodiment, the sound profile may be similarly computed from the amplitude column instead. A sound profile computed from a single pair of measurements may be regarded as a partial sound profile, but the actual sound profile is computed by combining multiple partial sound profiles, e.g., averaging them.

Figure 5:
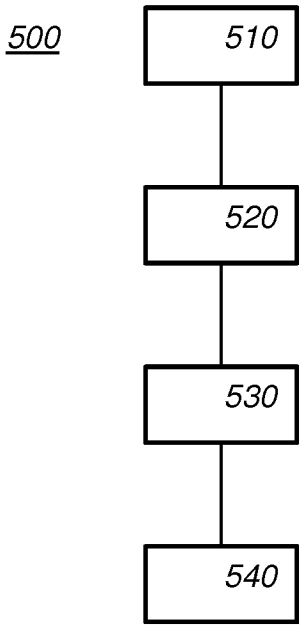
FIG. 5 schematically shows an example of an embodiment of a microphone calibration method, FIG. 6*a* schematically shows a computer readable medium having a writable part comprising a computer program according to an embodiment, FIG. 6*b* schematically shows a representation of a processor system according to an embodiment.

FIG. 5 schematically shows an example of an embodiment of a microphone calibration method 500. Microphone calibration method 500 is suitable for multiple microphones arranged in an area in which moving objects pass the microphones. Method 500 comprises

- arranging (510) communication with one or more microphones of the multiple microphones,
- obtaining (520) a first ambient sound measurement and a second ambient sound measurement of a moving object as it passes a first microphone (120) and a second microphone (130) of the multiple microphones, respectively
- computing (530) a first and second sound profile from said first and second sound measurements, said first and second sound profiles being indicative of a calibration of the first and second microphones,
- determine (540) a need to calibrate the first or second microphone if a difference between the first and second sound profile is beyond a threshold.

Many different ways of executing the method are possible, as will be apparent to a person skilled in the art. For example, the order of the steps can be varied or some steps may be executed in parallel. Moreover, in between steps other method steps may be inserted. The inserted steps may represent refinements of the method such as described herein, or may be unrelated to the method. For example, some of the steps may be executed, at least partially, in parallel. Moreover, a given step may not have finished completely before a next step is started.

A method according to the invention may be executed using software, which comprises instructions for causing a processor system to perform method 500. Software may only include those steps taken by a particular sub-entity of the system. The software may be stored in a suitable storage medium, such as a hard disk, a floppy, a memory, an optical disc, etc. The software may be sent as a signal along a wire, or wireless, or using a data network, e.g., the Internet. The software may be made available for download and/or for remote usage on a server. A method according to the invention may be executed using a bitstream arranged to configure programmable logic, e.g., a field-programmable gate array (FPGA), to perform the method.

It will be appreciated that the invention also extends to computer programs, particularly computer programs on or in a carrier, adapted for putting the invention into practice. The program may be in the form of source code, object code, a code intermediate source, and object code such as partially compiled form, or in any other form suitable for use in the implementation of the method according to the invention. An embodiment relating to a computer program product comprises computer executable instructions corresponding to each of the processing steps of at least one of the methods set forth. These instructions may be subdivided into subroutines and/or be stored in one or more files that may be linked statically or dynamically. Another embodiment relating to a computer program product comprises computer executable instructions corresponding to each of the means of at least one of the systems and/or products set forth.

Figure 6A:
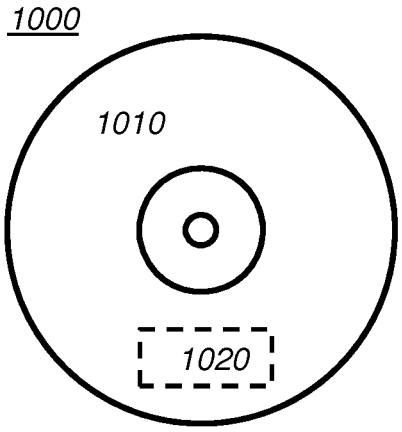

FIG. 6*a* shows a computer readable medium 1000 having a writable part 1010 comprising a computer program 1020, the computer program 1020 comprising instructions for causing a processor system to perform a calibration method, according to an embodiment. The computer program 1020 may be embodied on the computer readable medium 1000 as physical marks or by means of magnetization of the computer readable medium 1000. However, any other suitable embodiment is conceivable as well. Furthermore, it will be appreciated that, although the computer readable medium 1000 is shown here as an optical disc, the computer readable medium 1000 may be any suitable computer readable medium, such as a hard disk, solid state memory, flash memory, etc., and may be non-recordable or recordable. The computer program 1020 comprises instructions for causing a processor system to perform said method of calibration.

Figure 6B:
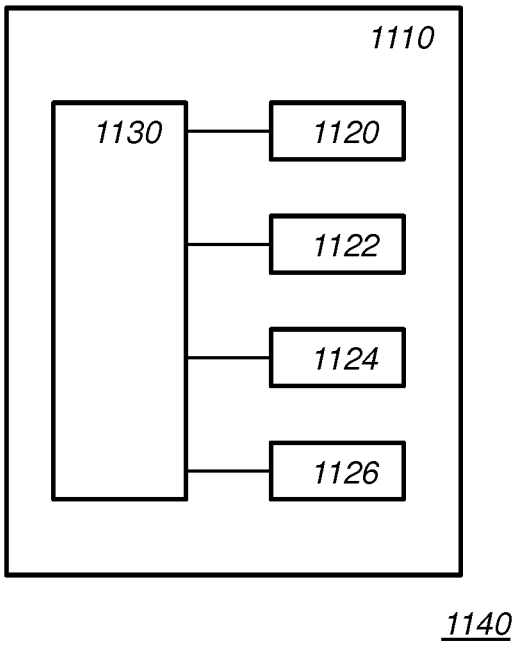

FIG. 6*b* shows in a schematic representation of a processor system 1140 according to an embodiment of a calibration system, e.g., calibration device 200. The processor system comprises one or more integrated circuits 1110. The architecture of the one or more integrated circuits 1110 is schematically shown in FIG. 6*b*. Circuit 1110 comprises a processing unit 1120, e.g., a CPU, for running computer program components to execute a method according to an embodiment and/or implement its modules or units. Circuit 1110 comprises a memory 1122 for storing programming code, data, etc. Part of memory 1122 may be read-only. Circuit 1110 may comprise a communication element 1126, e.g., an antenna, connectors or both, and the like. Circuit 1110 may comprise a dedicated integrated circuit 1124 for performing part or all of the processing defined in the method. Processor 1120, memory 1122, dedicated IC 1124 and communication element 1126 may be connected to each other via an interconnect 1130, say a bus. The processor system 1110 may be arranged for contact and/or contact-less communication, using an antenna and/or connectors, respectively.

For example, in an embodiment, a calibration system, e.g., calibration device 200 may comprise a processor circuit and a memory circuit, the processor being arranged to execute software stored in the memory circuit. For example, the processor circuit may be an Intel Core i7 processor, ARM Cortex-R8, etc. In an embodiment, the processor circuit may be ARM Cortex M0. The memory circuit may be an ROM circuit, or a non-volatile memory, e.g., a flash memory. The memory circuit may be a volatile memory, e.g., an SRAM memory. In the latter case, the device may comprise a non-volatile software interface, e.g., a hard drive, a network interface, etc., arranged for providing the software.

It should be noted that the above-mentioned embodiments illustrate rather than limit the invention, and that those skilled in the art will be able to design many alternative embodiments.

In the claims, any reference signs placed between parentheses shall not be construed as limiting the claim. Use of the verb 'comprise' and its conjugations does not exclude the presence of elements or steps other than those stated in a claim. The article 'a' or 'an' preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

In the claims references in parentheses refer to reference signs in drawings of exemplifying embodiments or to formulas of embodiments, thus increasing the intelligibility of the claim. These references shall not be construed as limiting the claim.

The invention claimed is:

1. A microphone calibration system for multiple microphones, said microphones being installed in multiple light poles and being arranged in an area in which moving objects pass the microphones, the system comprises:

the multiple light poles;

the multiple microphones;

a microphone calibration device comprising:

a communication interface arranged to communicate with one or more microphones of the multiple microphones;

one or more processor circuits arranged to obtain a first ambient sound measurement and a second ambient sound measurement of a moving object as it passes a first microphone and a second microphone of the multiple microphones, respectively; wherein the moving object is a motorized vehicle;

classify, with a classification unit, the moving object in the first ambient sound measurement and in the second ambient sound measurement, wherein said pair of ambient sound measurements being discarded if the moving object classifications in the first and second ambient sound measurement are different;

compute a first and second sound profile from said first and second sound measurements, said first and second sound profiles being indicative of a calibration of the first and second microphones;

determine a need to calibrate the first or second microphone if a difference between the first and second sound profile is beyond a threshold.

2. A microphone calibration system as in claim 1, wherein the microphone calibration device is configured to only be operated whenever the multiple light poles are providing light.

3. A microphone calibration system as in claim 1 further comprising a user interface, wherein the user interface is arranged for accommodating user interaction for performing a calibration action upon determining said need to calibrate the first or second microphone.

4. A microphone calibration system as in claim 1, wherein the microphones have corresponding calibration data, the one or more processor circuits being arranged to compute new calibration data for the first or second microphone to decrease the difference.

5. A microphone calibration system as in claim 1, wherein the one or more processor circuits are arranged to perform a third ambient sound measurement of the moving object as it passes a third microphone, compute a third sound profile from said third sound measurements, said third sound profiles being indicative of a calibration of the third microphones, determine a need to calibrate the first microphone if a difference between the first and second sound profile is beyond a threshold, but a difference between the second and third sound profile is within a threshold.

6. A microphone calibration system as in claim 1, wherein the sound profile is a sound pressure measurement at multiple time points within a time period of an approaching and/or receding car with respect to the microphone.

7. A microphone calibration system as in claim 1, wherein the one or more processor circuits is arranged to compare a frequency distribution of the first ambient sound measurement and the second ambient sound measurement, wherein said pair of ambient sound measurements is discarded if the frequency distributions differ beyond a threshold.

8. A microphone calibration system as in claim 1, wherein the sound profiles include the moving object both as the moving object approaches the microphone and as it recedes from the microphone, wherein a frequency distribution is compared separately for the approaching parts of the sound profiles as for the receding parts of the sound profiles.

9. A microphone calibration system as in claim 1, wherein the respective sound profile is a local maximum of the sound pressure level at a microphone.

10. A lighting device suitable for operation in the system according to claim 1-comprising a microphone, said microphone being arranged in an area in which moving objects pass the microphones, and the microphone calibration device.

11. A microphone calibration method for multiple microphones, said microphones being arranged in an area in which moving objects pass the microphones, the method comprises arranging communication with one or more microphones of the multiple microphones, obtaining a first ambient sound measurement and a second ambient sound measurement of a moving object as it passes a first microphone and a second microphone of the multiple microphones, respectively, wherein the moving object is a motorized vehicle, computing a first and second sound profile from said first and second sound measurements, said first and second sound profiles being indicative of a calibration of the first and second microphones, classifying the moving object in the first ambient sound measurement and in the second ambient sound measurement, wherein said pair of ambient sound measurements being discarded if the moving object classifications in the first and second ambient sound measurement are different, determine a need to calibrate the first or second microphone if a difference between the first and second sound profile is beyond a threshold.

12. A computer readable non-transitory medium having stored therein instructions for causing a processor to execute a method having a normal mode and a coordinator mode, the medium comprising code for:

a microphone calibration method for multiple microphones, said microphones being arranged in an area in which moving objects pass the microphones, the method comprises the steps of:

arranging communication with one or more microphones of the multiple microphones, obtaining a first ambient sound measurement and a second ambient sound measurement of a moving object as it passes a first microphone and a second microphone of the multiple microphones, respectively, wherein the moving object is a motorized vehicle, computing a first and second sound profile from said first and second sound measurements, said first and second sound profiles being indicative of a calibration of the first and second microphones, classifying the moving object in the first ambient sound measurement and in the second ambient sound measurement, wherein said pair of ambient sound measurements being discarded if the moving object classifications in the first and second ambient sound measurement are different, determine a need to calibrate the first or second microphone if a difference between the first and second sound profile is beyond a threshold.

* * * * *